United States Patent [19]

Nakamura et al.

[11] 4,424,019

[45] Jan. 3, 1984

[54] DEVICE FOR VERTICALLY MOVING THE WICK OF AN OIL BURNER

[75] Inventors: Kazuharu Nakamura, Nagoya; Yoshio Mito; Akiyoshi Okayasu, both of Gifu; Kazuhiko Takeuchi, Nagoya, all of Japan

[73] Assignee: Toyotomi Kogyo Co., Ltd., Aichi, Japan

[21] Appl. No.: 281,136

[22] Filed: Jul. 7, 1981

[51] Int. Cl.[3] ..... F23D 3/32

[52] U.S. Cl. ..... 431/307; 126/96; 431/201

[58] Field of Search ..... 431/195–201, 431/304, 307; 126/45, 96; 74/422

[56] References Cited

U.S. PATENT DOCUMENTS

| | | | |
|---|---|---|---|
| 1,479,406 | 1/1924 | Brent | 431/307 |
| 1,484,172 | 2/1924 | Chadwick | 431/307 |
| 2,503,153 | 4/1950 | Engh et al. | 431/307 |

FOREIGN PATENT DOCUMENTS

| | | |
|---|---|---|
| 33-2470 | 2/1958 | Japan . |
| 36-5450 | 3/1961 | Japan . |
| 39-22386 | 8/1964 | Japan . |
| 43-5020 | 3/1968 | Japan . |

*Primary Examiner*—Lee E. Barrett

*Attorney, Agent, or Firm*—Pollock, Vande Sande & Priddy

[57] ABSTRACT

A device for vertically moving a wick in an oil burner is disclosed which is capable of constantly ensuring the normal combustion operation of the oil burner. The device includes a drive shaft having a pinion, a rack disposed adjacent to a wick receiving chamber of the burner which is engaged with the pinion and connected to a wick to vertically move it when the drive shaft is rotated, and a stop member for stopping the movement of the rack with respect to the pinion only when the wick is lowered to the minimum normal combustion position to thereby ensure the normal combustion.

6 Claims, 3 Drawing Figures

DEVICE FOR VERTICALLY MOVING THE WICK OF AN OIL BURNER

BACKGROUND OF THE INVENTION

1. Field of the Invention

This invention relates to a wick operating device, and more particularly, to a device for vertically moving a wick in an oil burner which is capable of ensuring the normal combustion operation of the oil burner.

2. Description of the Prior Art

An oil burner utilizing a wick is generally adapted to move the wick in the vertical direction to accomplish the igniting and fire extinguishing operations and control the combustion. However, a conventional oil burner is not constructed to constantly accomplish the minimum normal combustion operation, therefore, it has been often used at the conditions that a wick is positioned away from its appropriate combustion range. In general, the conventional oil burner is capable of performing the complete combustion when the wick is positioned within its normal combustion range; however, when the wick is positioned away from the range, particularly, is lowered below the minimum normal combustion position, the oil burner causes a fuel oil to be incompletely burned and to generate a large amount of carbon monoxide and unburned hydrocarbon gas. A recent oil burner has been remarkably improved in combustion performance within the normal combustion range, therefore, it is highly desired to ensure the minimum normal combustion operation to prevent the generation of toxic and/or smelly gaseous materials such as carbon monoxide, unburned hydrocarbon gas and the like.

BRIEF SUMMARY OF THE INVENTION

The present invention has been made in view of the foregoing disadvantage in the prior art.

Accordingly, it is an object of the present invention to provide a device for vertically moving a wick in an oil burner which is capable of allowing the oil burner to constantly accomplish the normal combustion operation to prevent the generation of toxic and smelly gaseous materials in the combustion operation.

In accordance with the present invention, there is provided a device for vertically moving a wick in an oil burner which comprises a drive shaft rotatably mounted with respect to the oil burner, the drive shaft having a pinion; a rack means engaged with the pinion of the drive shaft, the rack means being provided adjacent to a wick receiving chamber of the oil burner and being connected with respect to the wick received in the wick receiving chamber so as to vertically move the wick when the drive shaft is rotated; a stop means provided adjacent to the pinion of the drive shaft and the rack means, the stop means being adapted to stop the movement of the rack means with respect to the drive shaft only when the wick is lowered to the minimum normal combustion position and to allow the drive shaft to be freely rotated between the maximum normal combustion limit and the minimum normal combustion limit.

The device of the present invention may be constructed in such a manner that the pinion of the drive shaft is engaged with the rack means so as to be slidable in the axial direction thereof with respect to the rack means at least at the minimum combustion position of the wick when the drive shaft is pulled; the drive shaft is forced toward the wick receiving chamber by a spring means; and the stop means is adapted to allow the fire extinguishing operation of the oil burner to be accomplished by rotating the drive shaft in the fire extinguishing direction thereof until it abuts on the stop means, rotating the drive shaft engaged with the stop means in the same direction keeping the engagement between the pinion and the rack means while pulling the drive shaft against the force of the spring means to release the engagement of the drive shaft with the stop means, and further, rotating the drive shaft in the same direction to move the wick to the lowermost position.

In addition, the device according to the present invention may be constructed in such a manner that an outer wall of the wick receiving chamber is movably disposed in the oil burner; the wick is fixed with respect to the outer wall of the wick receiving chamber; the rack means is mounted on the outer surface of the outer wall of the wick receiving chamber; and the stop means is mounted on the outer surface of the outer wall of the wick receiving chamber so that it engages with one end of the drive shaft only when the wick is lowered to the minimum combustion position in the combustion operation, to thereby stop the movement of the rack means with respect to the drive shaft. The stop means may comprise a projection formed to have a smooth slanting surface obliquely extending from the outer wall of the wick receiving chamber toward the drive shaft positioned when the oil burner is subjected to the combustion operation.

BRIEF DESCRIPTION OF THE DRAWING

The above and other objects and features of the present invention will be apparent from the following description taken in connection with the accompanying drawings, wherein.

DETAILED DESCRIPTION OF THE PREFERRED EMBODIMENT

Figure 1:
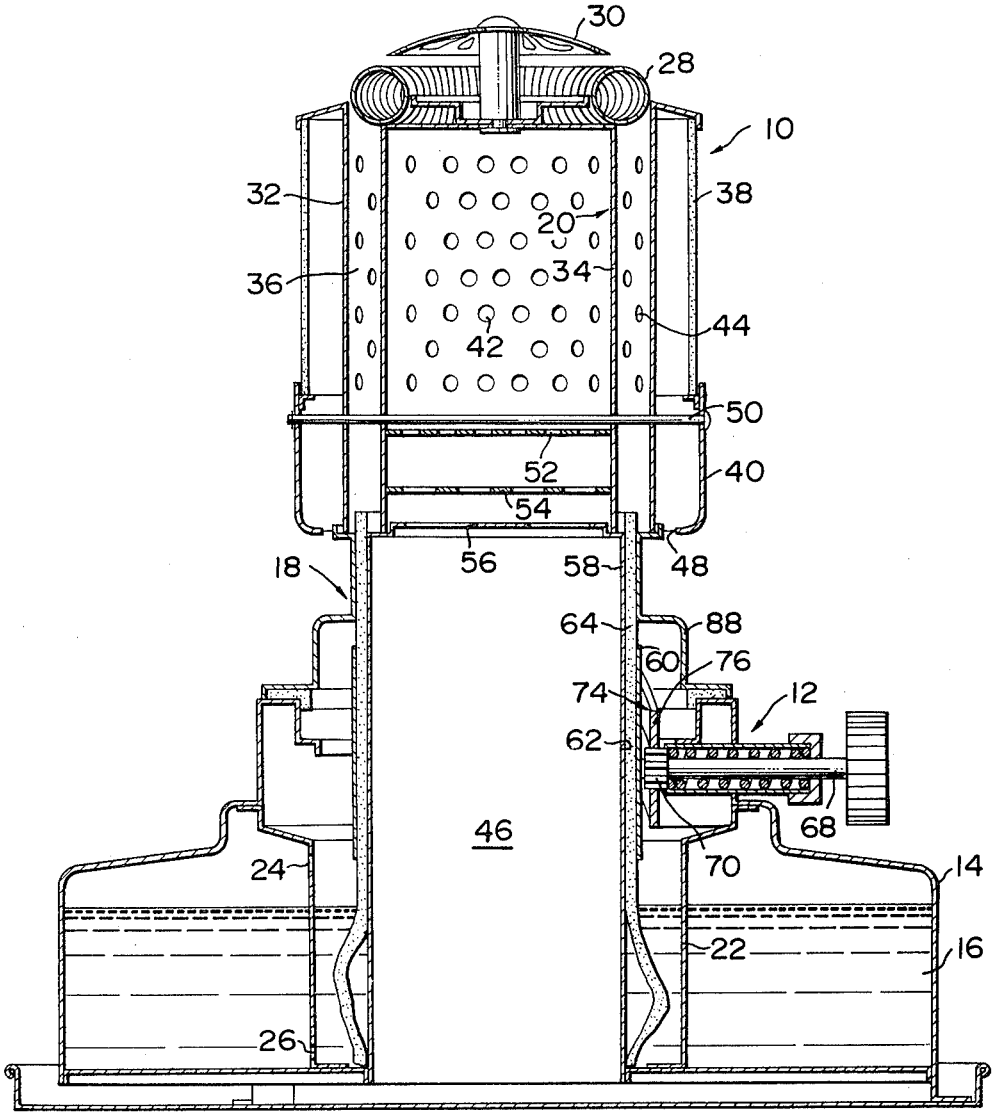
FIG. 1 is a longitudinal sectional view showing an oil burner having a device for vertically moving a wick according to the present invention incorporated therein.

Referring now to FIG. 1, there is schematically illustrated an oil burner 10 which incorporates therein a device 12 for vertically moving a wick (hereinafter referred to as "wick operating device") according to the present invention. The oil burner illustrated in FIG. 1 is an oil fired space heater type, however, it should be noted that an oil burner in which a wick operating device of the present invention may be incorporated is not limited to such oil fired space heater.

In FIG. 1, the oil burner is under the combustion operation. The oil burner 10 illustrated in FIG. 1 is constructed in such a manner as widely known in the art, except the wick operating device 12 of the present invention incorporated therein. The oil burner 10 includes an annular oil tank 14 for storing therein a fuel oil 16 such as kerosene, a wick receiving cylinder 18 disposed above the tank 14 and a combustion cylinder 20 disposed above the wick receiving cylinder 18. The oil tank 14 has a cylindrical partition 22 provided therein which has a vent hole 24 and an oil supply hole 26 arranged in a row in the vertical direction, so that the oil tank 14 may act as a pressure chamber to prevent a fuel oil therein flowing out from the oil burner when the oil burner has fallen down. Reference numerals 28 and 30 designate a coil and a top plate, respectively, which are adapted to be red-heated by flame within the combustion cylinder 20. The combustion cylinder 20 has cylindrical outer and inner walls 32 and 34 which define a combustion chamber 36 annular in section therebetween. Around the outer wall 32 of the combustion chamber 36 is disposed a transparent and heat resistant glass cylinder 38 through which radiant heat is emitted from the combustion chamber 36 to the outside. The glass cylinder 38 is supported by a retaining means 40 at a certain distance with respect to the combustion chamber 36. The inner and outer walls 34 and 32 of the combustion chamber are respectively provided with a lot of small through-holes 42 and 44 through which a flow of combustion air is introduced into the combustion chamber 36 from the lower portion of an internal cylindrical space 46 defined in the oil burner and from an annular opening 48 provided between the lower portion of the outer wall 32 of the combustion chamber 36 and the lower portion of the retaining means 40, respectively. The internal cylindrical space 46 is communicated at the lower portion thereof with an ambient atmosphere. The retaining means 40 is supported with respect to the combustion cylinder 20 by a retaining pin 50. The combustion cylinder 20 is detachably placed on the wick receiving cylinder 18.

Reference numerals 52, 54 and 56 indicate perforated plates which serve to control the flow of combustion air introduced from the lower portion of the internal space 46 through the holes 42 into the combustion chamber 36. For this purpose, holes of the uppermost plate 52 are largest in number and smallest in size, and holes of the lowermost plate 56 are smallest in number and largest in size.

The wick receiving cylinder 18 has an inner wall 58 and an outer wall 60 which define therebetween an annular chamber 62 for receiving a wick 64 therein. In the embodiment illustrated, the inner wall 58 is fixed with respect to the oil burner and the outer wall 60 is movably disposed with respect to the inner wall 60. The wick receiving chamber 62 is communicated with the combustion chamber 36. The wick 64 is securely supported on the inner surface of the outer wall 60 of the wick receiving chamber 62 by a suitable retaining means 66 (FIG. 2) such as projections provided on the inner surface of the outer wall 60 and is movable with respect to the inner wall 58 of the wick receiving chamber 62.

The wick operating device 12 according to the present invention is adapted to be disposed adjacent to the wick receiving chamber 62. The wick operating device 12 includes a drive shaft 68 which horizontally extends from the outside of the oil burner to the outer wall 60 of the wick receiving chamber 62. The drive shaft has a pinion 70 provided adjacent to one end thereof and a knob 72 at the other end thereof. On the outer wall 60 of the wick receiving chamber 62 is mounted a wick operating member 74 having a rack 76. The rack 76 is normally engaged with the pinion 70 of the drive shaft 68. The pinion 70 is engaged with the rack 76 so as to be slidable in the axial direction thereof with respect to the rack when the drive shaft 68 is pulled. Around the drive shaft 68 is disposed a spring 78 which acts to constantly force the drive shaft 68 toward the outer wall 60 of the wick receiving chamber 62.

Figure 2:
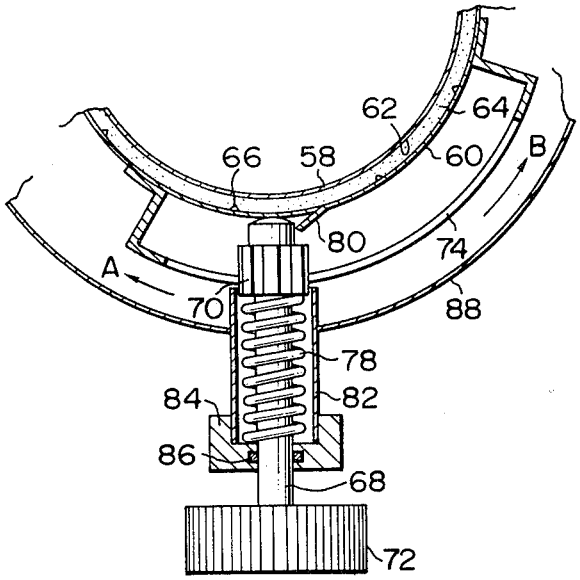
FIG. 2 is an enlarged plan view partly in section illustrating in detail the device of the present invention shown in FIG. 1, wherein the oil burner is under the minimum normal combustion.

Reference numeral 80 designates a stop member disposed on the outer surface of the outer wall 60 of the wick receiving chamber 62. The stop member 80, as shown in FIG. 2 wherein the oil burner is under the minimum normal combustion operation, is formed to obliquely project from the outer wall 60 of the wick receiving chamber in the direction indicated by an arrow A or toward the drive shaft 68 when the oil burner conducts the combustion operation so as to have a slanting surface smoothly ascending in the direction of the arrow A. The stop member 80 is positioned to engage with the tip end of the drive shaft 68 when the wick 64 is lowered to the position of allowing the oil burner to accomplish the minimum normal combustion operation, to thereby prevent the drive shaft 68 from further lowering the wick 64 in the combustion operation. Therefore, it will be noted that the stop member 80 is adapted to engage with the drive shaft 68 only in the wick lowering operation and only when the wick 64 has been lowered to the minimum normal combustion position.

The stop member 80 may be a projection formed by making a cut on a part of the outer wall 60 of the wick receiving chamber 62 and raising up the cut portion. Alternatively, the stop member 80 may be a projection mounted on the outer wall 60. In the embodiment, the fire extinguishing operation of the oil burner 10 is easily accomplished by rotating the drive shaft 68 in the counterclockwise direction or the fire extinguishing direction thereof until it abuts on the stop member 80, rotating it in the same direction keeping the engagement between the pinion 70 and the rack 76 while pulling the drive shaft 68 against the spring 78 to disengage the drive shaft 68 from the stop member 80, and further, rotating the shaft 68 in the same direction to fully lower the wick 64 into the wick receiving chamber 62. The igniting operation also is accomplished with ease by rotating the drive shaft 68 in the clockwise direction to raise the wick 64 to the uppermost position and igniting a vaporized fuel oil generated from the wick. In the igniting operation, it is possible to smoothly rotate the drive shaft 68 contacting it with the outer wall 60 of the wick receiving chamber 62 inclusive of the slanting surface of the stop member 80, therefore, the rotation of the drive shaft 68 can be easily accomplished without forcibly pulling the drive shaft against the spring 78.

Figure 3:
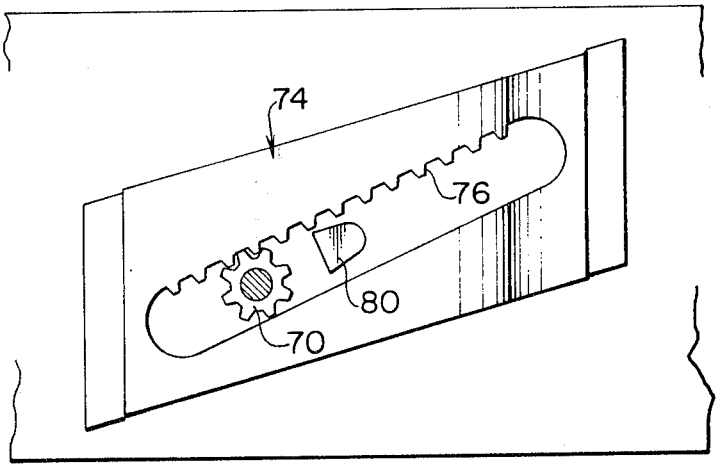
FIG. 3 is a schematic view showing the relationship among a gear, a rack means and a stop means in the device of the present invention.

In the embodiment, the rack 76 is positioned so as to ascend in the direction indicated by an arrow B in FIG. 2, as shown in FIG. 3. However, it is also possible to dispose the rack 76 horizontally with respect to the outer wall 60 of the wick receiving chamber 62 and directly connect the rack 72 with the wick 64 by means of a pin (not shown) extending between the rack and the wick through a slanting groove (not shown) provided at the outer wall 60 of the wick receiving chamber 62. In such case, the outer wall of the wick receiving chamber is fixedly disposed as well and the wick 64 is movably disposed with respect to the inner and outer walls 58 and 60 of the wick receiving chamber 62.

The portion of the drive shaft 68 having the spring 78 provided therearound is surrounded by a cover 82 having a lid 84 put thereon. Reference numeral 86 indicates a O-ring interposed between the lid 84 and the drive shaft 68 to prevent vaporized or liquid fuel oil from leaking through a gap therebetween. The pinion 70 and rack 76 are received in an enclosure formed by an outer cover 88 and the wick receiving cylinder 18. In the embodiment a part of the cover 88 acts as an additional outer wall of the wick receiving chamber 62 above the outer wall 60.

The manner of operation of the wick operating device according to the present invention will now be described with reference to the drawings.

The igniting operation of the oil burner is accomplished by rotating the drive shaft 68 in the clockwise direction to move the rack 72 in the direction indicated by the arrow B in FIG. 2 to raise the wick 64 from the lowermost position to the uppermost position and then igniting a vaporized fuel oil generated from the wick 64 by means of a suitable ignition means (not shown). When the drive shaft 68 is rotated in the igniting operation, it contacts with the smooth slanting surface of the stop member 80 on the way. Therefore, the drive shaft 68 is smoothly rotated to move the outer wall 60 of the wick receiving chamber 62 beyond the stop member 80, to thereby raise the wick 68 to the uppermost position. In the normal combustion state, the wick is vertically moved within the range between the uppermost position and the minimum normal combustion position or the position where the drive shaft engages with the stop member. Therefore, it will be noted that the control of combustion by the drive shaft always ensures the normal combustion to prevent the generation of toxic and/or smelly materials. FIG. 2 shows the situation that the wick 64 is lowered to the minimum normal combustion position.

The fire extinguishing operation of the oil burner is accomplished by rotating the drive shaft 68 in the counterclockwise direction until it abuts on the stop member 80, rotating the drive shaft 68 in the same direction keeping the engagement between the pinion 70 and the rack 76 while pulling it against the spring 78 to disengage the drive shaft 68 from the stop member 80, and further, rotating the drive shaft in the same direction to lower the wick 64 to the lowermost position.

In view of the foregoing, it will be understood that the wick operating device according to the present invention is capable of constantly keeping the range of normal combustion of the oil burner with simple construction, to thereby effectively prevent troubles caused due to the excessive lowering of the wick in the combustion operation.

Obviously many modifications and variations of the present invention are possible in the light of the above teachings. It is therefore to be understood that, within the scope of the appended claims, the invention may be practiced otherwise than as specifically described.

What is claimed is:

1. A device for vertically moving a wick in an oil burner comprising:

a drive shaft having a pinion;

means for rotatably mounting said drive shaft on said burner;

a rack means engaged with said pinion of said drive shaft, said rack means being provided adjacent to a wick receiving chamber of said oil burner and being connected with respect to said wick received in said wick receiving chamber so as to vertically move said wick when said drive shaft is rotated;

a stop means provided adjacent to said pinion and said rack means, said stop means being adapted to engage said drive shaft to stop the movement of said rack means with respect to said drive shaft only when said wick is lowered to the minimum normal combustion position and to allow said drive shaft to be freely rotated between the maximum normal combustion limit and the minimum normal combustion limit; and means for disengaging said stop means and said drive shaft to permit continued lowering of said rack means and said wick to the combustion extinguishing position.

2. A device for vertically moving a wick as defined in claim 1, wherein said wick receiving chamber has an outer wall; and means for movably disposing said outer wall in said oil burner, further comprising means for fixing said wick with respect to the inner surface of said outer wall of said wick receiving chamber;

means for mounting said rack means on the outer surface of said outer wall of said wick receiving chamber; and means for mounting said stop means on the outer surface of said outer wall of said wick receiving chamber so that it engages with one end of said drive shaft only when said wick is lowered to the minimum combustion position, to thereby stop the movement of said rack means with said drive shaft.

3. A device for vertically moving a wick as defined in claim 2, wherein said means for disengaging comprises:

said pinion of said drive shaft is engaged with said rack means so as to be slidable in the axial direction of said drive shaft with respect to said rack means at least at the minimum normal combustion position of said wick when said drive shaft is pulled;

said drive shaft is forced toward said wick receiving chamber by a spring means; and said stop means is adapted to allow the fire extinguishing operation of said oil burner to be accomplished by rotating said drive shaft in the fire extinguishing direction thereof until it abuts on said stop means, rotating said drive shaft engaged with said stop means in the same direction keeping the engagement between said pinion and said rack means while pulling said drive shaft against the force of said spring means to release the engagement of said drive shaft with said stop means, and further, rotating said drive shaft in the same direction to move said wick to the lowermost position.

4. A device for vertically moving a wick as defined in claim 3, wherein said stop means comprises a projection formed to have a smooth slanting surface obliquely extending from said outer surface of said outer wall of said wick receiving chamber toward said drive shaft positioned when said oil burner is subjected to the combustion operation.

5. A device for vertically moving a wick as defined in claim 4, wherein said projection is formed by a part of said outer wall of said wick receiving chamber.

6. A device for vertically moving a wick in an oil burner, comprising:

a drive shaft having a pinion;

means for horizontally and rotatably mounting said drive shaft on said burner;

a rack means engaged with said pinion, said rack means being mounted on the outer surface of an outer wall of a wick receiving chamber of said oil burner;

means for movably disposing said outer wall of said wick receiving chamber;

means for fixing said wick to said outer wall of said wick receiving chamber so that it is vertically moved through said rack means when said drive shaft is rotated;

a stop means provided on the outer surface of said outer wall of said wick receiving chamber so as to engage with one end of said drive shaft only when said wick is lowered to the minimum normal combustion position, to thereby stop the movement of said drive shaft with respect to said rack means, said stop means comprising a projection formed to have a smooth slanting surface obliquely extending from said outer surface of said outer wall toward said drive shaft positioned when said oil burner is subjected to the combustion operation;

a spring means disposed on said drive shaft to force said drive shaft toward said wick receiving chamber;

said pinion being engaged with said rack means so as to be slidable in the axial direction of said drive shaft with respect to said rack means when said drive shaft is pulled.

* * * * *